US006059120A

United States Patent [19]

Rohr et al.

[11] Patent Number: 6,059,120

[45] Date of Patent: May 9, 2000

[54] DEVICE FOR WASHING OUT AND CLASSIFYING ORGANIC CLAY-LIKE AND OTHER IMPURITIES FROM GRANULAR MATTER

[75] Inventors: Wolfgang Rohr, Mörschstrasse 57a, D-67265 Waldsee, Germany; Klaus Bleh, Rödersheim, Germany

[73] Assignee: Wolfgang Rohr, Waldsee

[21] Appl. No.: 09/145,626

[22] Filed: Sep. 2, 1998

[30] Foreign Application Priority Data

Sep. 4, 1997 [DE] Germany ..... 197 38 676

[51] Int. Cl.[7] ..... B03B 5/08

[52] U.S. Cl. ..... 209/428; 209/430

[58] Field of Search ..... 209/428–433, 209/920

[56] References Cited

U.S. PATENT DOCUMENTS 702,541 6/1902 Cohen et al. .

1,030,427 6/1912 Pinder .

2,612,267 9/1952 Vogel .

2,825,462 3/1958 Hockney et al. .

FOREIGN PATENT DOCUMENTS

3839666C1 2/1990 Germany .

*Primary Examiner*—David H. Bollinger

*Attorney, Agent, or Firm*—Collard & Roe, P.C.

[57] ABSTRACT

A device for washing out and classifying organic, clay-like and other impurities from gravel, comprising a charging chute for feeding material into a washing trough. The washing trough comprises a conveyor belt designed to move in a direction perpendicular to the direction of the flow of material and a plurality of shower devices designed to act against the direction of travel of the belt. The conveyor belt is supported by a series of support rollers and tension rollers. These support rollers and tension rollers are supported by a machine frame that can be incline adjusted

12 Claims, 9 Drawing Sheets

DEVICE FOR WASHING OUT AND CLASSIFYING ORGANIC CLAY-LIKE AND OTHER IMPURITIES FROM GRANULAR MATTER

BACKGROUND OF THE INVENTION

1. Field of the Invention

The invention relates to a device for washing out and classifying organic, clay like matter and other impurities from continuously fed coarsely and finely granular solid matter such as freshly dredged and prepared gravel. The device contains a charging chute for feeding the material into a washing trough. The washing trough is comprised of a conveyor belt and a series of shower devices. The conveyor belt is supported on a series of support and tension rollers. These rollers are mounted on the frame of a machine, whereby the washing trough is formed by the conveyor belt which comprises a part adjoining the washing trough, and raised in the direction of the conveyor belt.

2. Description of the Prior Art

Devices for washing organic matter are known in the art. For example German patent No. 38 39 666 C1 discloses a device for feeding material into a washing trough with the help of a charging trough and shower device. In this case, the conveyor belt is disposed below the charging chute and is elevated against the flow of the charged material. Furthermore, a knocking or striking roller which is cooperating with the conveyor belt and coupled with the drive of the latter, is disposed within the area of the washing trough. One substantial drawback of this device is that as the soiled material is being charged, the material already cleaned has to pass through the charged material, which causes the cleaned material to become soiled again. This means that no special degree of purification is obtained within this type of device, and the material cleaned in this way needs to be fed again into such a device. Another drawback in this connection is the required high consumption of water and consequently an increased consumption of energy. Moreover another drawback is that this separation is limited to heavy and light materials.

The present invention is designed as an improvement over the prior art and provides a substantially enhanced charging chute having a series of stages. The charging chute along with the novel design of the invention allows the device to have a higher separation density. Another important advantage is that the device can be easily adapted to account for differences in the degree of contamination of the charged material, and in the differences in the density of the material. In addition, another advantage is that this device has a lower structural height.

SUMMARY OF THE INVENTION

The invention consists of a charging chute for feeding charged material that into a washing trough. The washing trough is made from a conveyor belt and a plurality of shower devices. The conveyor belt has a roughened surface and moves perpendicular to the direction of the flow of material down the chute. Shower devices are located upstream of the site where the material is deposited. These shower devices act against the direction in which the conveyor belt is running.

In one embodiment of the invention, the charging chute is designed to comprise one or more stages with a gap between each stage. Each of these gaps are opposed by at least one shower device that can be adjusted with respect to their position and pressure. The stages of the charging chute are comprised of metal sheets. These metal sheets are inclined relative to the conveyor belt and are adjustable relative to this incline rate. In addition, battle plates that are adjustable on their front and rear edges can be mounted on the conveyor belt.

This charging chute is equipped with a vibrating motor, and there is at least one knocking or striking roller equipped with its own controllable drive in the area of the washing trough.

In a second embodiment of the invention, the machine frame is adjustable with respect to the incline of the machine. In addition, in this embodiment there is a dynamic dewatering device for dewatering the material.

It is therefore an object of the invention to enhance the degree of purification so that a higher separation density can be achieved.

It is another object of the invention is to provide a device that can be easily adapted to account for differences in the degree of contamination of the charged material, and in differences in the density of the material.

It is another object of the invention is to provide a device which has a lower structural height.

Finally, it is a further object of the invention is to provide a device that is simple in design, inexpensive to manufacture and reliable in operation.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

Figure 4:
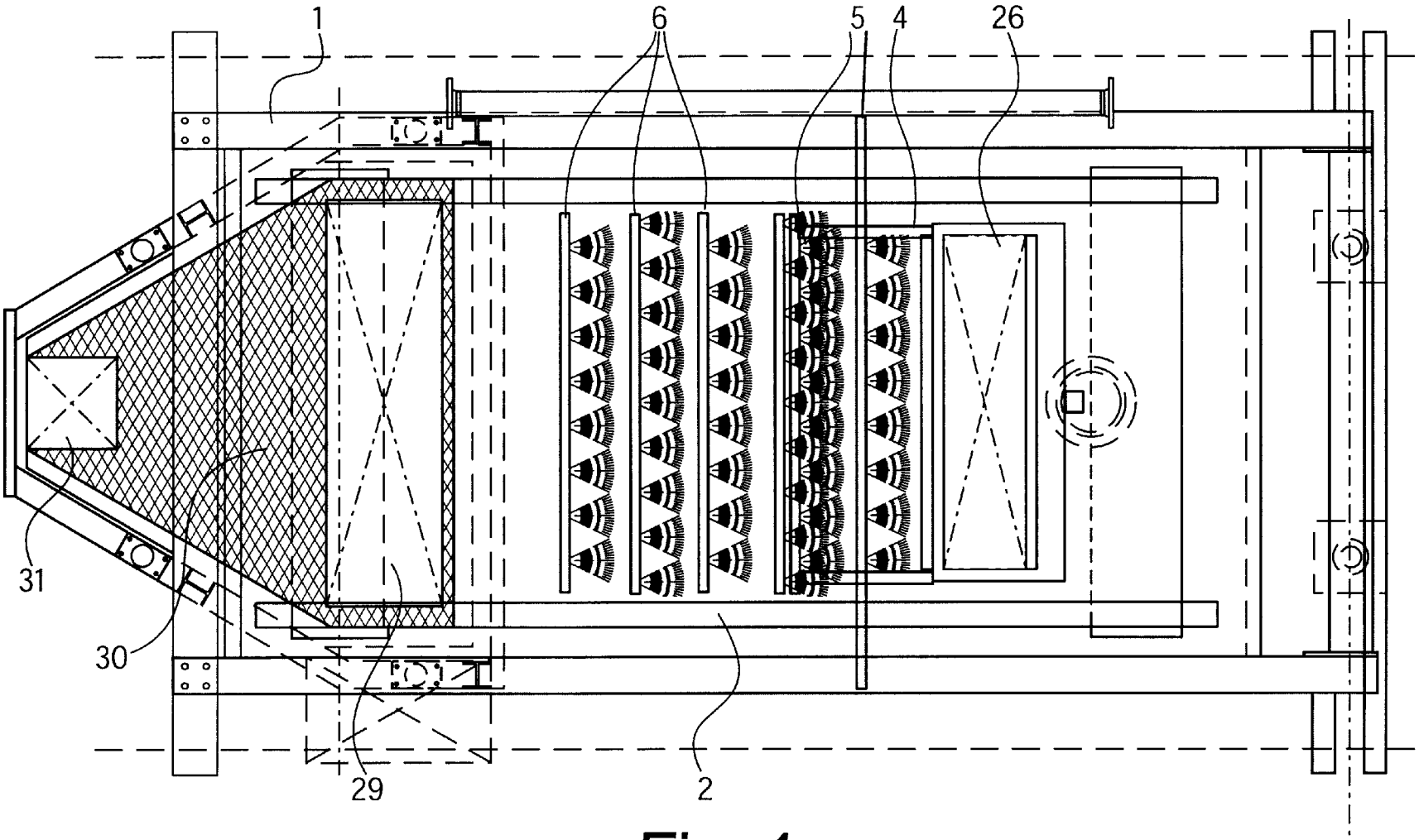
Figure 5:
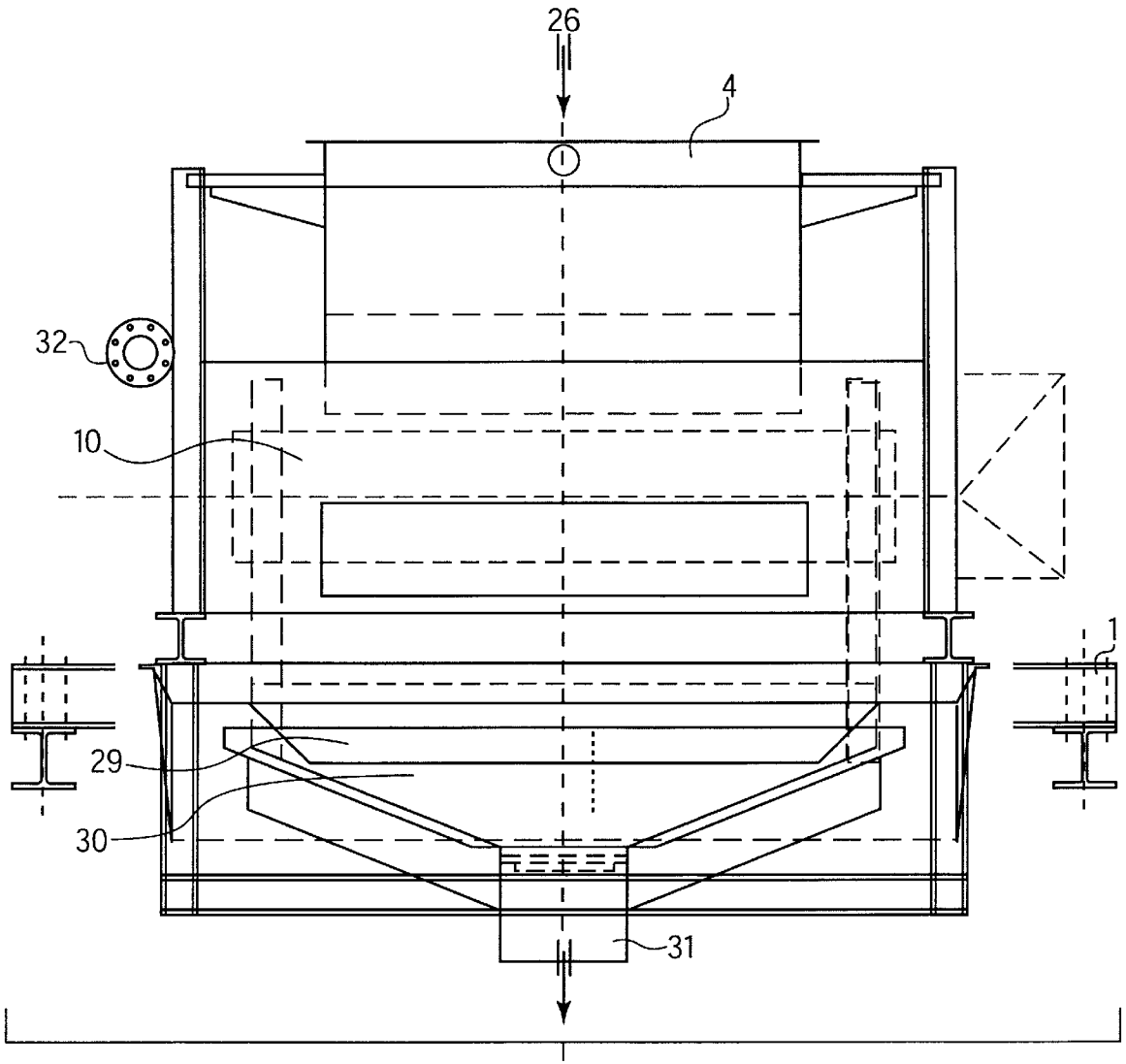
Figure 6:
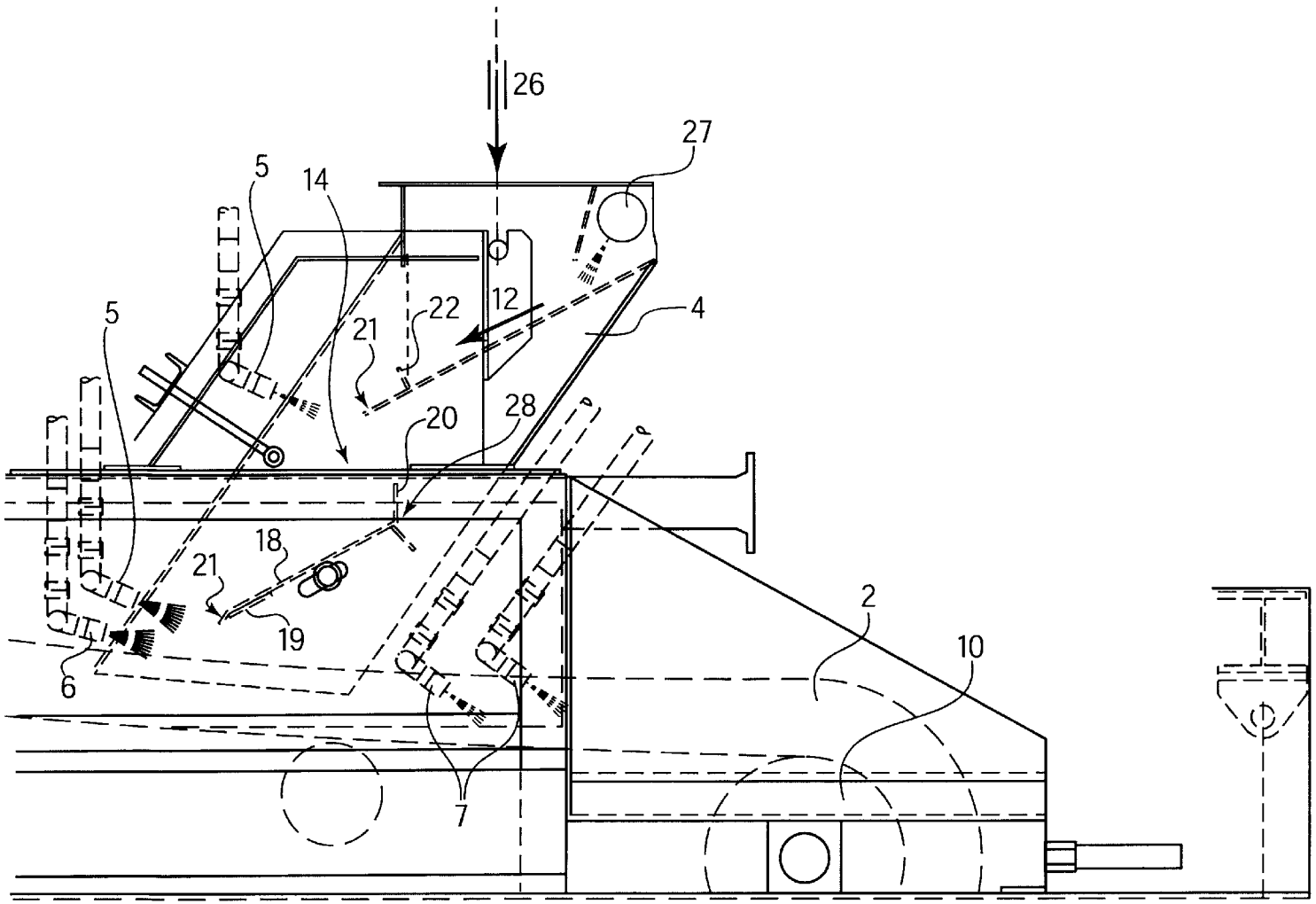
Figure 7:
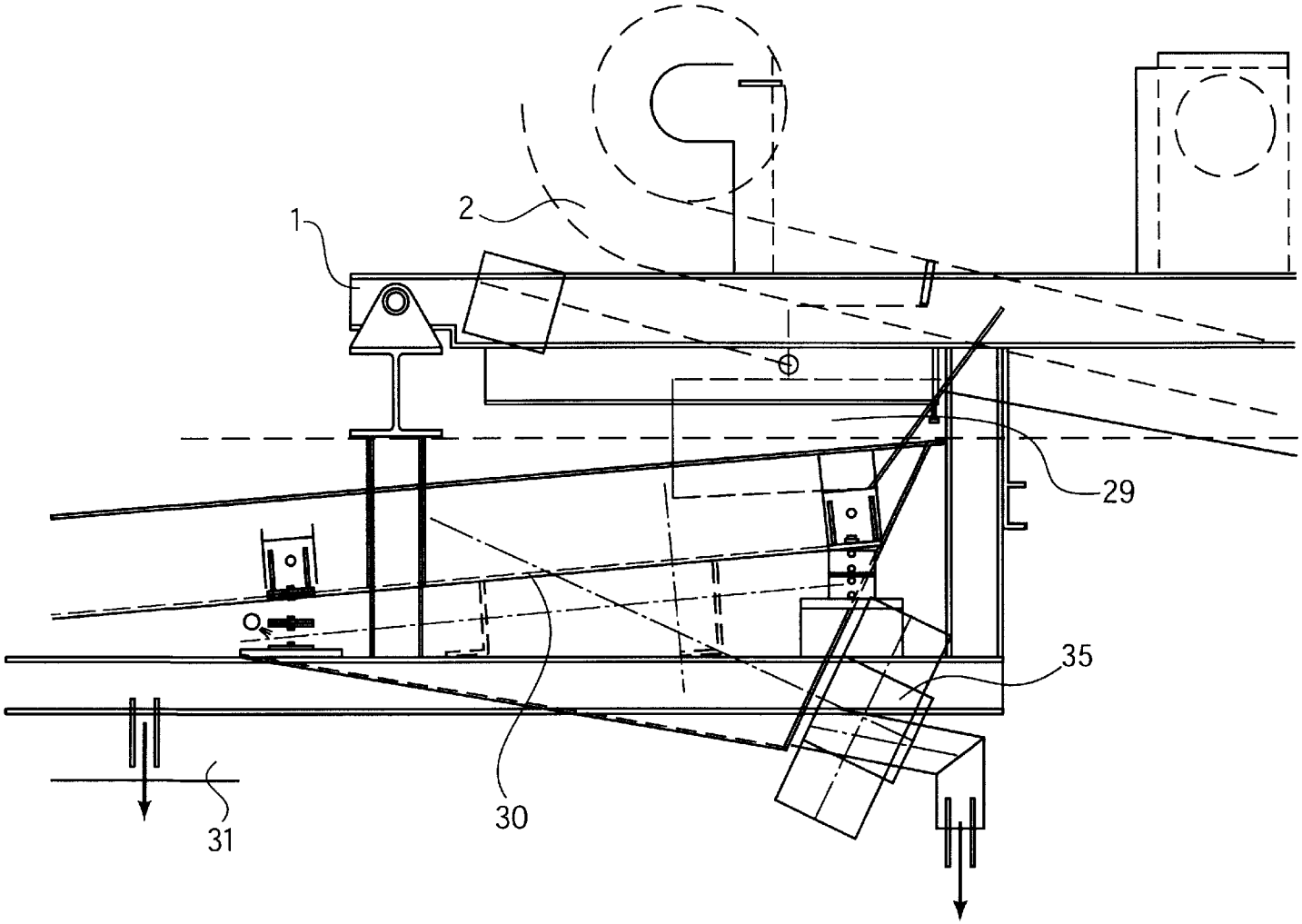
Figure 8:
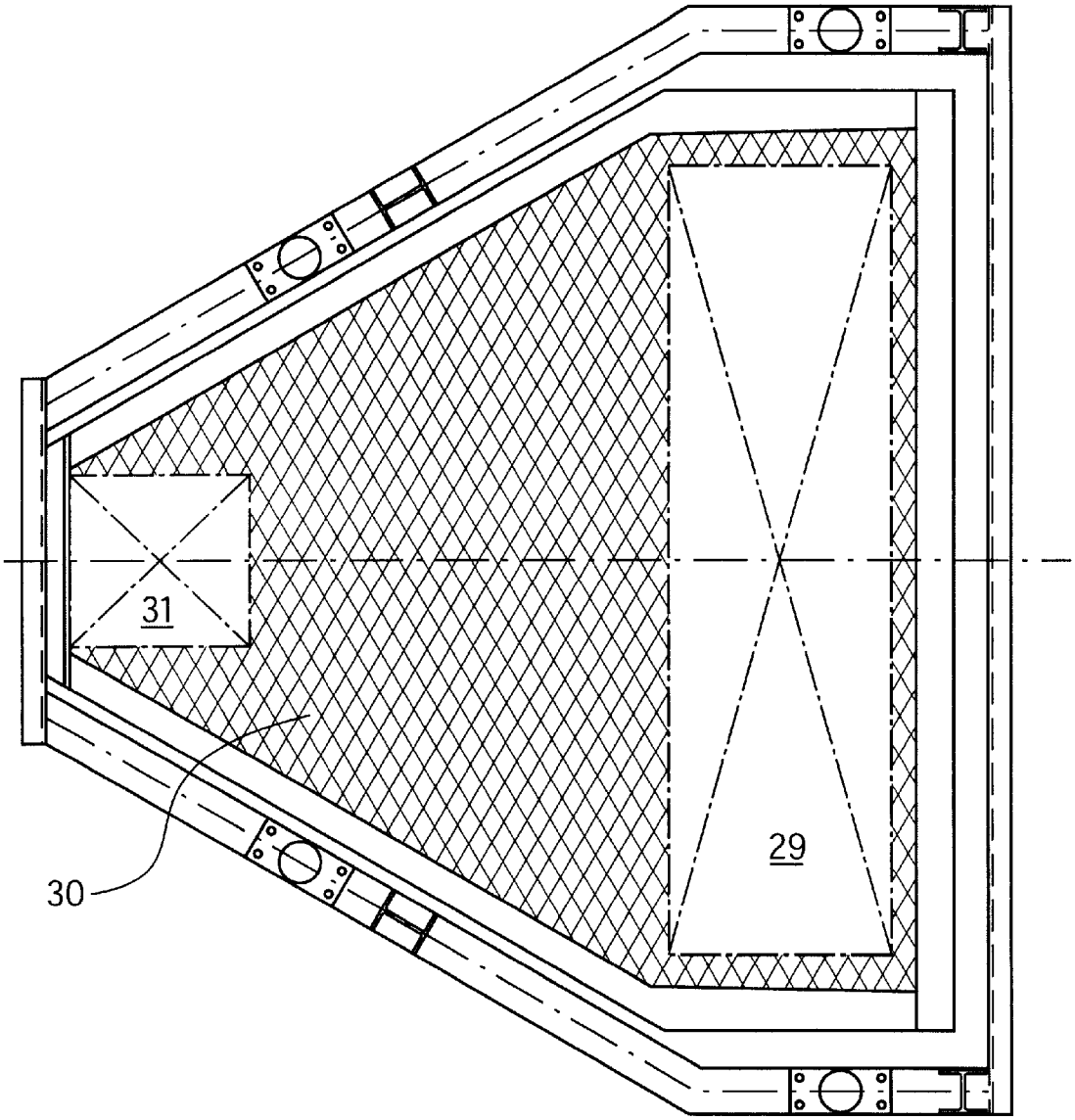

PIG. 3 shows a side view of a second embodiment of the device with a static charging chute;

FIG. 4 is a top view of the second embodiment of the invention;

FIG. 5 is a front-side view of the second embodiment of the invention;

FIG. 6 is an enlarged view of the static charging device in the region of the chute;

FIG. 7 is a side view of the dynamic dewatering device arranged on the device;

FIG. 8 is a top view of the dewatering device according to FIG. 7; and

Figure 9:
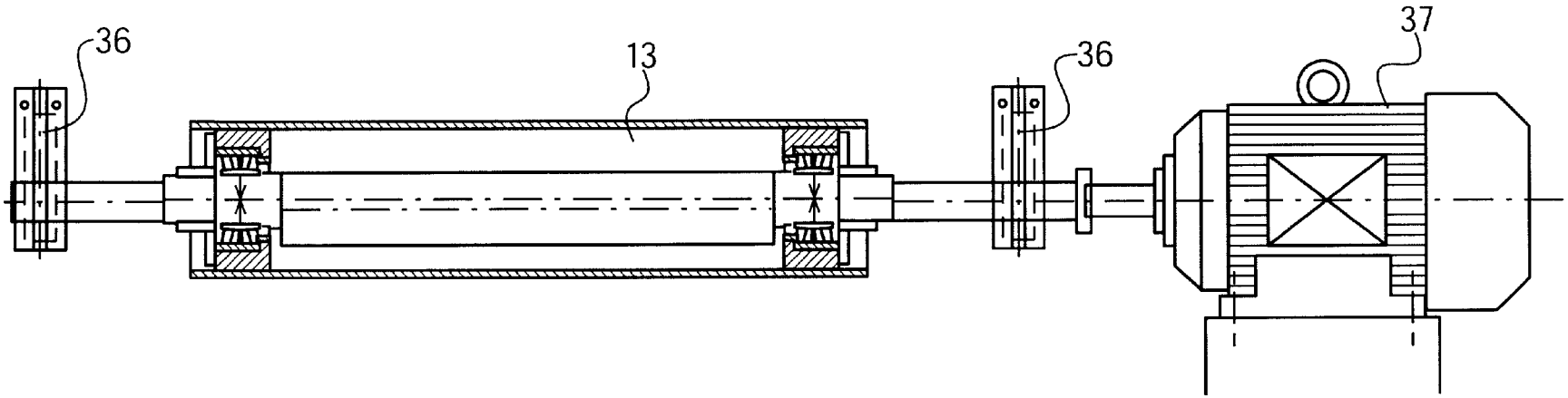

FIG. 9 is a view of the knocking roller drive.

DETAILED DESCRIPTION OF THE PREFERRED EMBODIMENT

Figure 1:
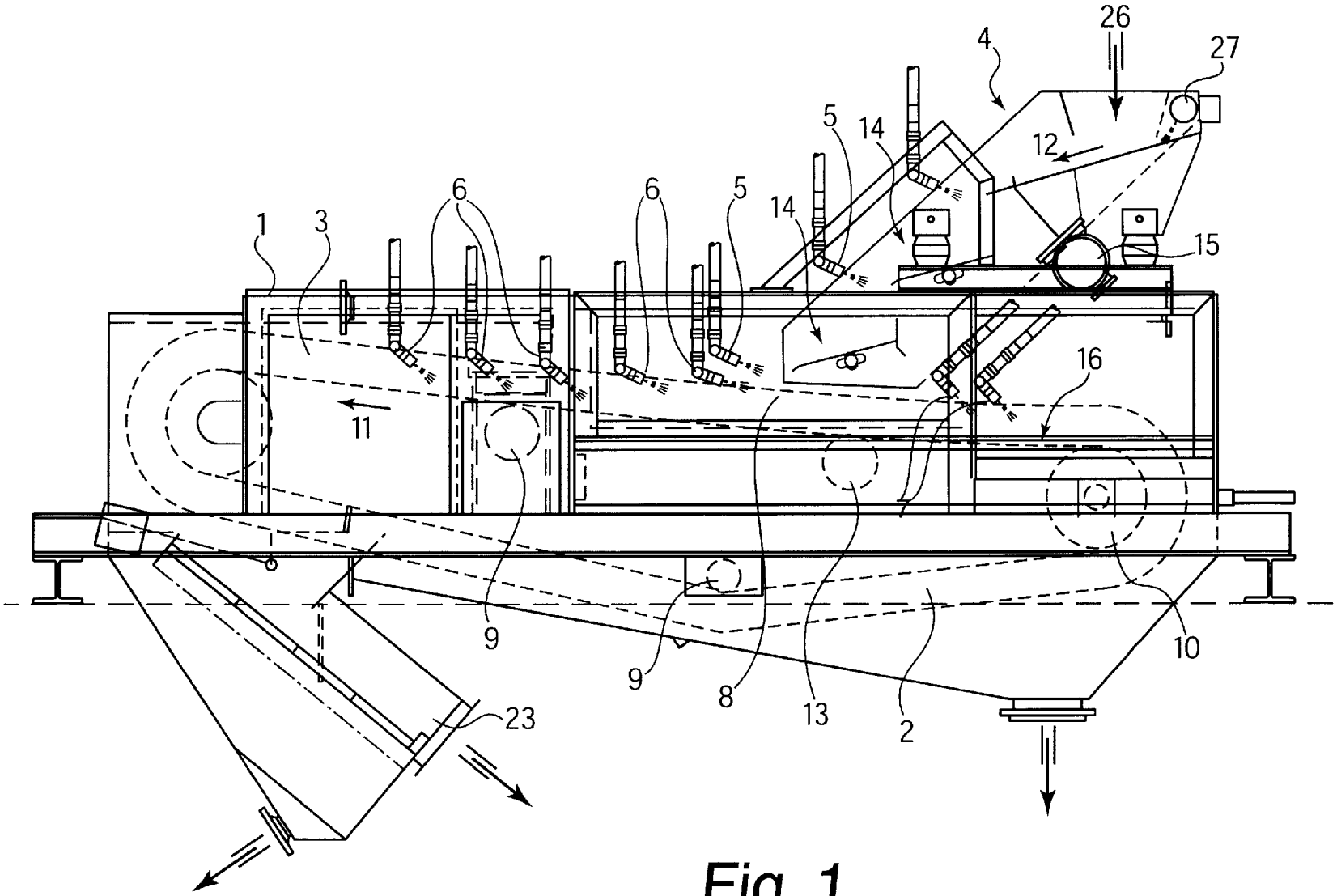
FIG. 1 shows a first embodiment of the device with a static dewatering device.
Figure 2:
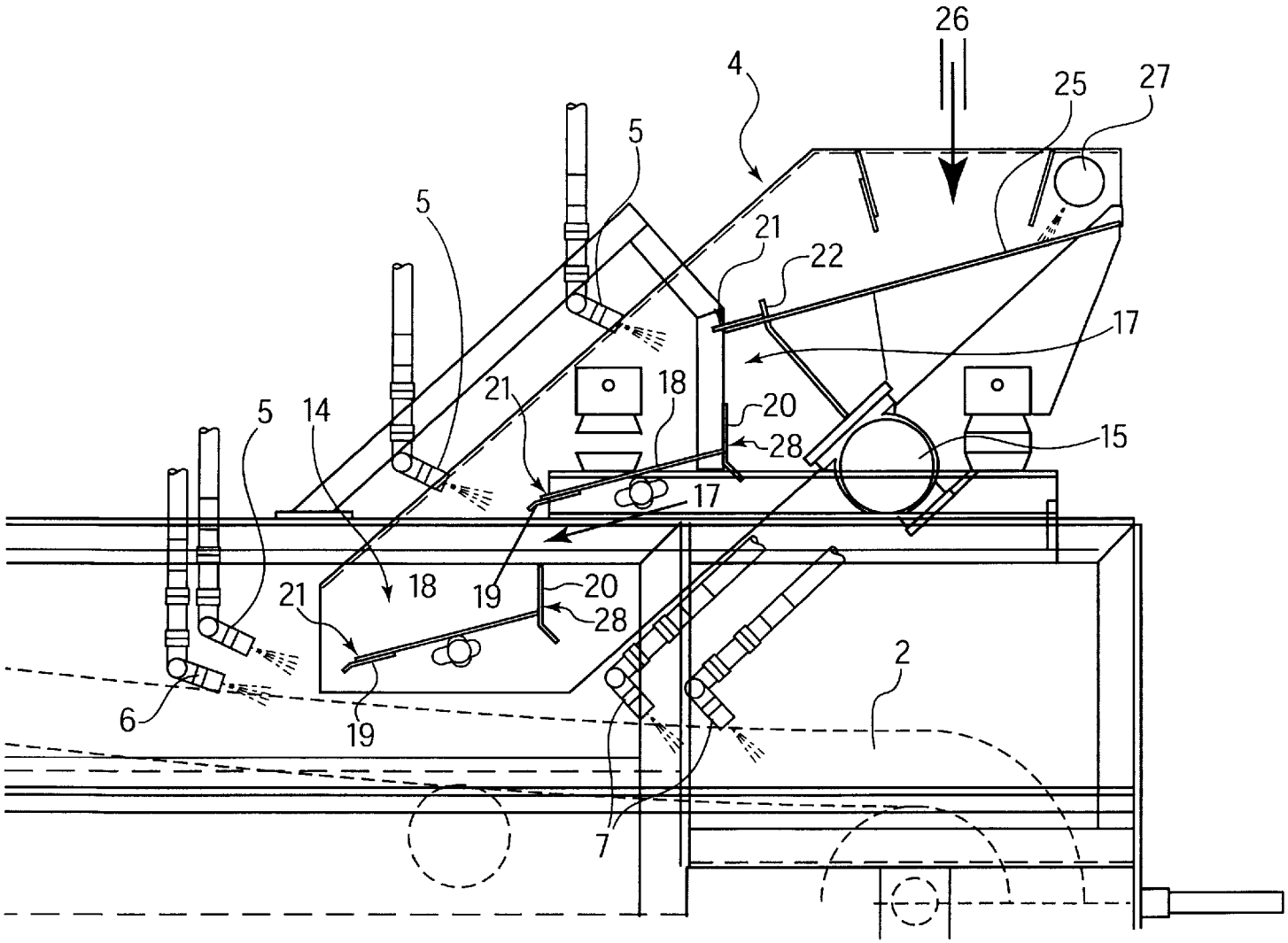
FIG. 2 shows an enlarged view if the charging chute as a dynamic component.

Referring to FIGS. 1 and 2 the device comprises a conveyor belt 2 that is guided over two reversing rollers 10 and 10' and support rollers 9 and 9'. Conveyor belt 2 travels in the direction shown by arrow 11. The upper strand of conveyor belt 2 forms a washing trough 8, starting at right reversing roller 10 and ending up at an elevated portion. The casing of machine frame 1, and a corrugated edge of the belt is raised upwardly along the edge, and serves to limit side slipping of the conveyor belt. In addition, the drive mechanism of the conveyor belt is controllable.

A charging chute 4 is shown having a top filling opening 26. Filling opening 26 sends the material in flow direction 12 which is also the direction of travel 11 of belt 2. The material then flows into charging chute 4 which is received in washing trough 8. An adjustable shower 27 can also be placed in charging chute 4 which is designed to flush the material into chute 4. The charging chute is designed in multiple stages, so that the material to be cleaned is fed to washing trough 8 in a cascade manner over two stages namely a first stage 14 and second stage 14'. Individual shower devices 6 are mounted along washing trough 8 in the area of the elevated portion 3 of conveyor belt 2. Shower devices are adjustable with respect to their incline, position, height and pressure, whereby the jets are directed against belt travel direction 11. Additional shower devices 7 are provided adjacent to the right hand side of washing trough 8 near roller 10. In this way, the shower devices are also directed against the direction of travel 11 of belt 2.

Shower devices 5, 6, and 7 cover the entire width of the chute so that shower device 5 can wash the particles over the entire width and height of the drop. In addition, other shower devices, 6, and 7 extend over the total width of conveyor belt 2. In this way, lightweight particles and particles with unfavorable shapes are completely flushed out of the system.

FIG. 2 shows an enlarged view of the charging chute 4. Chute 4 is designed as a dynamic chute having a vibrating motor 15 for vibrating chute 4. Filling opening 26 is adjoined by an upper, downwardly inclined metal sheet 25, which is fitted with a baffle part 22 extending over the entire width. Below front edge 21 of metal sheet 25 is another metal sheet 18. Metal sheet 18 of first stage 14 extends across the width of chute 4, and is fitted on its rear edge with baffle plate 20 and on its front edge with baffle plate 19. Baffle plates 20 and 20' extend vertically along rear edge of plates and a gap 17 is left between top metal sheet 25 and baffle plate 20. In another stage 14', another metal sheet 18' with baffle plates 19' and 20' is present below metal sheet 18.

Baffle plates 20 and 20' can be adjusted on their rear edge 28 and 28' so that it can enlarge or reduce gaps 17 and 17'. Furthermore, front baffle plate 19 can be adjusted with respect to its longitudinal direction or incline. Showers 5 are directed against front edge 21 and 21' of metal sheets 25 and 18, and can be adjusted based upon their pressure and incline.

In addition, knocking or striking roller 13 of FIG. 1 can be mounted on conveyor belt 2 in other locations. Knocking roller 13 has its own controllable drive 37, and is laterally mounted on eccentrics 36 and driven by motor drive 37 (FIG. 9).

Figure 3:
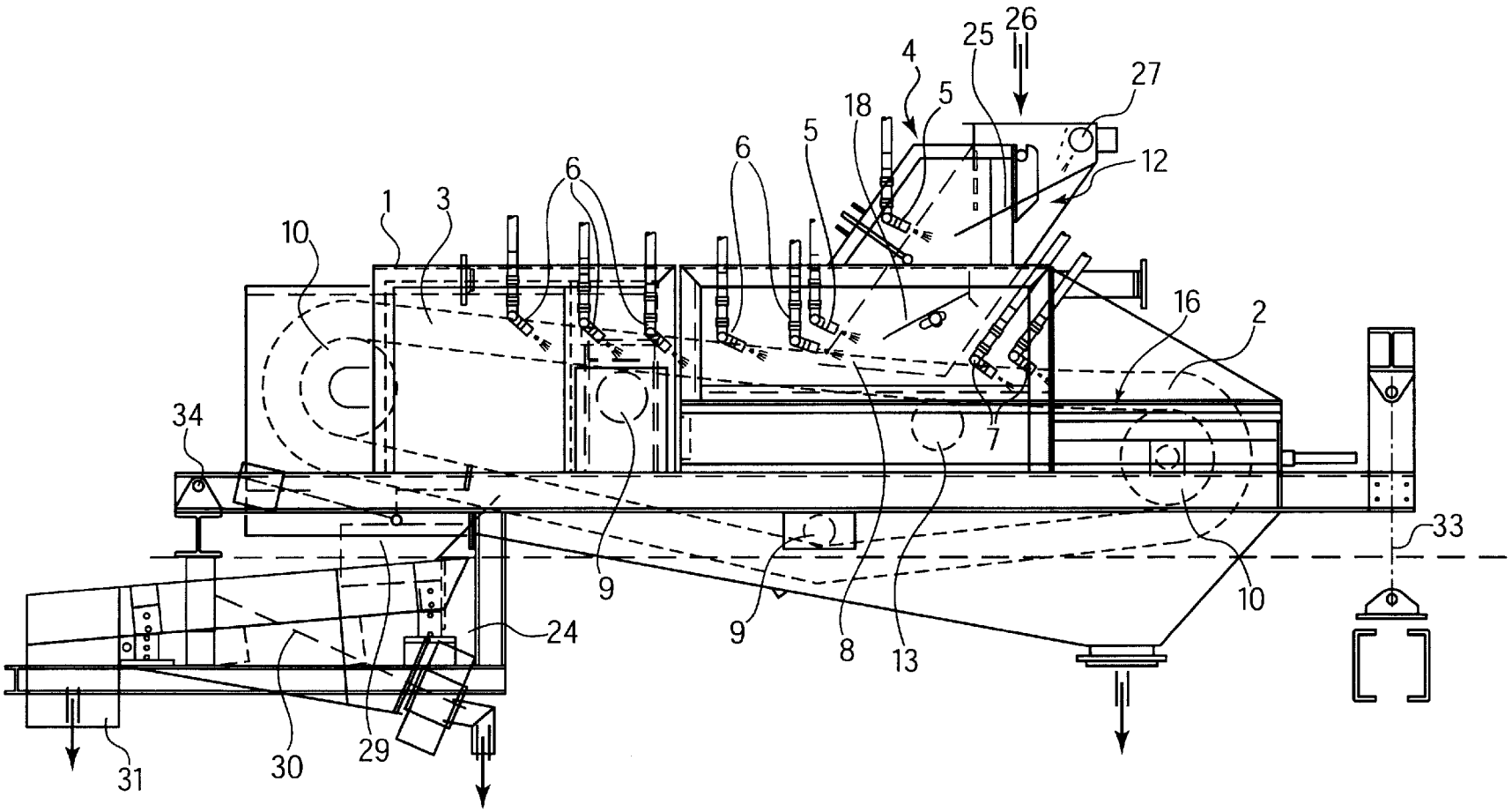

Dewatering device 23 is mounted on machine frame 1 opposite chute 4. FIG. 3 shows an additional embodiment of dewatering device 23 comprising a charging opening 29 and a dewatering gutter 30. The material to be de-watered is received in opening 31 where the material is transported away via conveyor belts 2.

The embodiment shown in FIGS. 3 through 6 shows a static charging chute 4, whereby this embodiment differs from the embodiment of FIGS. 1 and 2 in that vibrating motor 15 is missing. In addition, in this embodiment there is only one stage 14 with a metal sheet 18, with this stage following uppermost sheet 25. Furthermore, the dynamic dewatering device is arranged on the material outlet, so that this embodiment has a lower structural height. This dewatering device is equipped with a pivoting drive 35 (FIG. 7), whereby the dewatering gutter 30 extends conically towards outlet or discharge opening 31 in the form of a slotted screen bottom (FIGS. 4 and 8).

FIG. 4 discloses a top view of the second embodiment of the invention showing shower devices 6 spread across the width of belt 2. Shower devices 6 are positioned to spray water against the flow of material on belt 2.

FIG. 5 is a front end view of the second embodiment of the invention showing dewatering gutter 30 positioned below charging opening 29. Positioned above charging opening 29 is reversing roller 10.

FIG. 6 is a side view of the second embodiment of charging chute 4 showing a shower 27 for flushing the material into chutes 25 and 18.

FIG, 7 is a side view of dewatering gutter 30 that has a charging or feeding gutter 29 located above, and an opening for material discharge below. In addition a swing or pivot drive 35 is located on dewatering gutter 30 with the pivot drive 35 designed to control the opening of dewatering gutter 30.

FIG. 8 shows a top view of dewatering gutter 30 having an opening to receive material discharge 31. At an opposite end is a charging or feeding opening 29.

FIG. 9 is a view of knocking roller 13 having an eccentric 36 positioned on both ends and a controllable drive 37 positioned on one end.

While two embodiments of the present invention have been shown and described, it is to be understood that many changes and modifications may be made thereunto without departing from the spirit and scope of the invention as defined in the appended claims.

What is claimed is:

1. A device for washing out and separating organic, clay-like matter and other impurities from gravel like material comprising:

a) a machine frame housing;

b) a charging chute disposed above said machine frame for feeding material into said frame;

c) a washing trough disposed within said housing and to receive said fed material said washing trough comprising;

i) a conveyor belt for receiving material from said charging chute and conveying the material in a direction of travel that is not opposite the direction of flow of material being fed by said charging chute, said belt having an inclined portion;

ii) a plurality of shower devices disposed above said belt and directed to act against the direction of travel of said conveyor belt; and d) a plurality of support and tension rollers disposed within said housing for supporting said conveyor belt so that as the material is moved along said conveyor belt it is washed by said shower devices.

2. The device according to claim 1, wherein the charging chute is equipped with a vibrating motor.

3. The device according to claim 1, wherein said shower devices have adjustable positions and pressures.

4. The device according to claim 1, further comprising at least one knocking roller disposed within said housing and having its own controllable drive.

5. The device according to claim 1, wherein said conveyor belt has a rough surface.

6. The device according to claim 1, wherein said machine frame has an adjustable incline.

7. The device according to claim 1, wherein said conveyor belt has a rough surface.

8. The device according to claim 1, further comprising a static dewatering device positioned on the incline portion of said conveyor belt.

9. The device according to claim 1, further comprising a dynamic dewatering device positioned on the incline portion of said conveyor belt.

10. A device for washing out and separating organic, clay-like matter and other impurities from gravel like material comprising:

a) a machine frame housing;

b) a charging chute disposed above said machine frame for feeding material into said frame wherein said charging chute has at least two stages whereby there is a gap between stages being opposed by at least one of said plurality of shower devices;

c) a washing trough disposed within said housing and to receive said fed material said washing trough comprising;

i) a conveyor belt for receiving material from said charging chute said belt having an inclined portion;

ii) a plurality of shower devices disposed above said belt and directed to act against the direction of travel of said conveyor belt; and d) a plurality of support and tension rollers disposed within said housing for supporting said conveyor belt so that as the material is moved along said conveyor belt it is washed by said shower devices.

11. The device as in claim 10, wherein the stages of the charging chute comprise metal sheets having a front edge and a back edge adjustably inclined relative to said conveyor belt said chute further comprising adjustable baffle plates that are mounted on the front and rear edges of said metal sheets.

12. The device according to claim 10, wherein the first of said stages is provided with a baffle part that extends over the total width of said stage.

* * * * *